United States Patent [19]

Büdenbender

[11] Patent Number: 5,016,775

[45] Date of Patent: May 21, 1991

[54] BUNG-TYPE CONTAINER

[76] Inventor: Bernd Büdenbender, Schubertweg 5, 2160 Stade, Fed. Rep. of Germany

[21] Appl. No.: 393,702

[22] Filed: Aug. 14, 1989

[30] Foreign Application Priority Data

Aug. 13, 1988 [DE] Fed. Rep. of Germany ..... 3827551
Aug. 29, 1988 [DE] Fed. Rep. of Germany ..... 3829240
Aug. 29, 1988 [DE] Fed. Rep. of Germany ..... 3829230

[51] Int. Cl.[5] ..... B65D 41/04

[52] U.S. Cl. ..... 220/288; 220/303; 220/304; 220/366

[58] Field of Search ..... 220/288, 303, 366, 378, 220/304; 215/356, 357

[56] References Cited

U.S. PATENT DOCUMENTS

| | | | |
|---|---|---|---|
| 2,156,237 | 4/1939 | Draper | 220/288 X |
| 2,293,943 | 8/1942 | Merker et al. | 220/288 X |
| 2,308,089 | 1/1943 | McClary | 220/288 X |
| 2,460,721 | 2/1949 | Thompson | 220/288 X |
| 2,962,185 | 11/1960 | Starr et al. | 220/288 X |
| 3,884,382 | 5/1975 | Ball | 220/272 |
| 3,935,968 | 2/1976 | Rausing | 215/356 X |
| 4,033,369 | 7/1977 | Keller | 220/288 X |
| 4,094,432 | 6/1978 | Zilbert | 220/288 X |
| 4,114,779 | 9/1978 | Stoll, III | 220/288 |
| 4,231,488 | 11/1980 | Ward et al. | 220/288 |

FOREIGN PATENT DOCUMENTS

| | | | |
|---|---|---|---|
| 582198 | 8/1959 | Canada | 220/288 |
| 473450 | 5/1925 | Fed. Rep. of Germany | 220/288 |
| 610862 | 9/1926 | France . | |
| 847537 | 10/1939 | France . | |
| 429477 | 7/1967 | Switzerland | 220/288 |
| 306515 | 5/1929 | United Kingdom | 220/288 |
| 320173 | 10/1929 | United Kingdom | 220/288 |
| 1074059 | 6/1967 | United Kingdom . | |

*Primary Examiner*—Stephen Marcus
*Assistant Examiner*—Nova Stucker
*Attorney, Agent, or Firm*—Herbert Dubno

[57] ABSTRACT

A tube stub is formed from the material of a sheet metal cover to define the bunghole of a drum, cask or barrel and is provided with a screwthread into which the bung is threadedly fitted so that the bung will press a seal against an annular sealing surface defined by the tube stub.

7 Claims, 9 Drawing Sheets

BUNG-TYPE CONTAINER

CROSS REFERENCE TO RELATED APPLICATIONS

This application is related to the commonly owned copending applications Ser. No. 07/237,904 filed Aug. 29, 1988, Ser. No. 07/240,315 filed Sept. 2, 1988 and Ser. No. 07/300,459 filed Jan. 19, 1989.

FIELD OF THE INVENTION

My present invention relates to a bung-type container and, more particularly, to a bung-type cask, barrel or generally drum composed of sheet metal and having a screw-type bung or plug which can be inserted matingly into a bunghole.

BACKGROUND OF THE INVENTION

A bung-type container of the kind with which the invention is concerned, generally has a body, a bottom rigidly and sealingly connected to the body and a top or cover likewise rigidly and sealingly connected to the body, e.g. by a folded seam at the upper chime of the body.

The cover has at least one filling opening, hereinafter referred to as a bunghole into which a bung or plug can fit. The plug can have a screwthread which mates with a screwthread in the bunghole to provide a liquid tight and gas tight closure for the drum, cask or barrel.

A bung-type container of the kind described, composed of relatively thin sheet metal, can be used as a barrel or drum for a variety of liquids or flowable bulk solids. It can be used as a cask for beverages, e.g. as a beer barrel or keg.

Generally the wall thickness of the structure forming the bunghole must be relatively large in conventional barrels so that a threaded fitting adapted to form the bunghole is attached to the cover of the drum or barrel by a screw connection, by rolling over sheet metal portions, by a pressing operation or by welding the fitting in or onto the cover.

As a consequence, fabrication of the container requires a larger number of parts than may be desirable to form a cover which is satisfactory and also mandates a number of fabrications steps to ensure a firm attachment of the fitting and a sealing between the fitting and the cover which can increase the cost of fabrication of the barrel to an excessive degree. Special means may be required for providing a seal between the bung and the cover and such means can include additional sealing rings.

It is also common practice to provide the fixture with additional sealing rings.

The conventional constructions are, however, fraught with a number of problems. For example, drop tests have shown that the region between a rigid fixture or fitting and the thin sheet metal cover is subjected to local stresses which can destroy the connection or so damage it that leakage can occur.

The provision of sealing rings between the fitting and the cover not only means that additional elements are required but that a variety of considerations in the handling of the container will arise. For example, many conventional types of elastic sealing rings may not be resistant to the substances with which the container is to be filled so that the use of such sealing rings must take into consideration the ultimate use of the container and the products which are to be packaged or transported therein.

Furthermore, the use of elastic sealing rings may impede the handling of the containers since the seals may be affected by solvents and cleaning agents used in cleaning the container or by high temperatures utilized in the cleaning process.

Indeed, if the container is equipped with an elastic ring between the fitting and the cover, a variety of cleaning agents may be excluded from use and it may not be possible to employ elevated cleaning temperatures.

OBJECTS OF THE INVENTION

It is, therefore, the principal object of the present invention to provide an improved metal container of the bung type which is free from the aforementioned drawbacks, can allow the use of a threaded bung with high sealing reliability and which can be fabricated at a minimum cost.

Another object of this invention is to provide an improved bung-type container which will be less susceptible to local stress and will maintain sealing effectiveness even when subjected to handling of a type which in the past may have sprung the connection between the bunghole fittings of earlier barrels or drums and the respective covers.

SUMMARY OF THE INVENTION

These objects and others which will become apparent hereinafter are attained, in accordance with the invention in that the bunghole is bounded by a tubular stub which is formed in one piece with the cover and from the material thereof, this tube stub being provided with an internal screwthread to receive the screwthread of the bung. Furthermore, the tube stub defines an annular sealing surface against which a sealing ring of the bung can be seated.

As a consequence of this construction, the known relatively massive and thick-walled fittings hitherto applied by welding, pressing or rolling, is replaced by a simple, thin walled, easily fabricated tube stub manufactured in one piece from the material which can be displaced by formation of the bunghole and because of this one piece association of the tube stub with the cover, any additional sealing medium, sealing ring or the like between the tube stub and the cover can be eliminated.

The material of the cover which is an outcropping over the filling opening is formed in one piece from the annular sealing surface described to the threaded portion of the tube stub. Alternatively, the sealing surface can be defined by the end of the tube stub.

What is important is that the tube stub as it extends simply or as it is folded over to provide inner and outer walls, be drawn from material already part of the cover, although a reinforcing ring or added threaded member can be applied with simple configuration for additional reinforcement. The folding of an inner wall into an outer wall can be effected in a simple operation.

The bung-type cask of the invention can therefore comprise:

- a container body;
- a container bottom closing one end of the container body;
- a container cover closing an opposite end of the container body, the container cover being formed with at least one bunghole and, bounding the opening and formed in one piece with the cover, a tube stub having an internal screwthread and defining an annular sealing surface surrounding the opening and located on a side of the cover turned away from the container body; and an externally threaded bung threadedly received removably in the tube stub, forming a stopper for the opening and having a sealing ring pressed against the surface.

According to a feature of the invention, the sealing surface can be formed as an annular step surrounding the bunghole. The tube stub can also be formed within or extend into the interior of the container and can have a laterally opening hole sealed by insertion of the bung, but serving, by its proximity to the inner surface of the cover, to enable full draining of the contents thereof.

A free upper end of the tube stub can have an outwardly turned collar and the junction between the tube stub and the cover can be formed with a fold or corrugation enabling the tube stub to more flexibly withstand shocks and prevent excessive stress transmission to the cover.

In its inwardly folded version, the tube stub is double-walled and has an outer wall extending transversely from the cover and an inner wall formed with a female thread. An outer transition region between the two walls can form the sealing surface which can be either perpendicular or normal to the axis of the tube stub or inclined inwardly or outwardly thereto by virtue of a frustoconical shape. The inner end of the inner wall can be joined to the outer wall by one or more weld spots or an annular weld seam and, according to a further feature of the invention, a reinforcing ring may be held between the inner and outer wall.

The tube stub can be lined internally by an internally threaded ring in another advantageous construction of the invention.

According to other features of the invention, moreover, the internal screwthread can be formed on the tube stub only over angularly spaced segments thereof. The tube stub can be coined or compacted into a portion having a greater wall thickness in the cover at least over a portion of the length of the tube stub formed with the internal screwthread. A protective coating of a synthetic resin or lacquer can be applied on the tube stub and at least a portion of the inner surface of the cover adjoining the tube stub.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
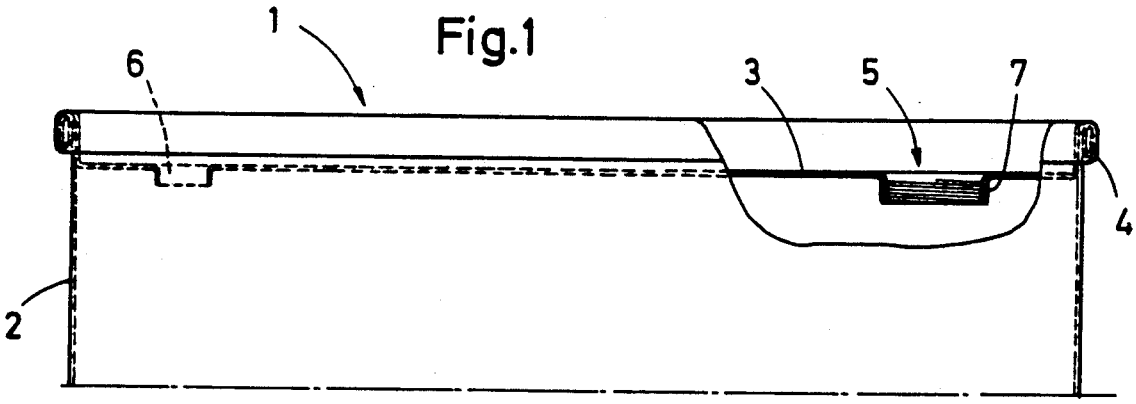
FIG. 1 is a fragmentary elevational view, partly broken away of the upper portion of a container according to the invention having two bungholes for respective bungs.

FIG. 1 shows the upper part of the a bung-type container, according to the invention which is composed of sheet metal and comprises a generally cylindrical body 2, the upper portion of which is partly broken away.

The upper end of the container 1 is sealingly closed by a cover 3 which can be affixed to the body 2 by a rolled over fold 4 forming the chime at the upper end and of conventional construction. The cover 3 has two filling opening or bungholes which, as usually is the case, can be of a different diameter.

The bunghole 5 can, for example, have a diameter of two inches and is used for filling and emptying while the bunghole 6 can have a diameter of three-quarters of an inch and is used primarily for venting. The bungholes are provided with tube stubs, one of which can be seen at 7 for threadedly receiving a respective bung of a type shown in FIG. 3, for example and which can press a sealing ring against an annular sealing surface to provide a gas tight and liquid tight seal.

Figure 2:
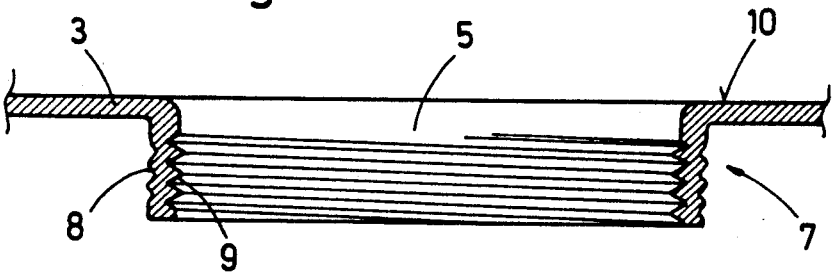
FIG. 2 is a cross sectional view greatly enlarged with respect to FIG. 1 but showing one of the bungholes and tube stubs thereof according to the invention.

In FIG. 2 the cover 3 can be seen to be formed in one piece with the tubular member 8 forming the tube stub 7 around the bunghole 5. The member 8 is stamped from the sheet metal of the cover and forced from the plane of the cover downwardly into the interior of the container. An internal screwthread can be formed in this tube stub 8 by stamping so that the outer surface of the tube stub 8 also has a contour similar to that of a screwthread. While the screwthread is pressed into the tube stub in the embodiment of FIG. 2, if desired, it can be cut therein, rolled, embossed or otherwise shaped in the tube stub.

When the material of the tube stub 8 is pressed from the material of the cover, care is taken that at the route of the tube stub 8 an exactly planar annular surface 10 is formed to accommodate a sealing ring.

Figure 3:
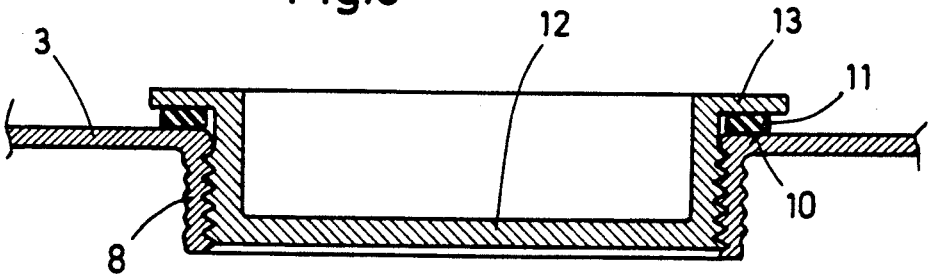
FIG. 3 is a view similar to FIG. 2 showing a bung in place.

As can be seen from FIG. 3, the sealing ring 11 is pressed against the annular sealing surface 10 by an annular flange 13 of a bung or stopper 12 which is externally threaded and is threadedly received in the internal thread 9 of the tube stub 8. The sealing ring 11 provides the requisite sealing resilience. A similar bung can, of course, be used in the other embodiments illustrated.

Figure 4:
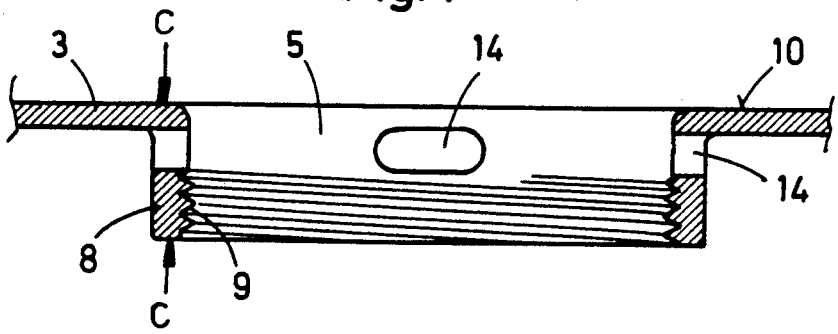
FIG. 4 is a view similar to FIG. 2 of a modification thereof enabling improved emptying of the container.

FIG. 4 shows a modification of the embodiment of FIGS. 2 and 3, in which, as in the other embodiments, a hole is first punched in the cover 3 and then the material surrounding this hole is pressed downwardly to form the cover 8. During the pressing operation compression is applied between the arrows C so that the tube stub 8 is coined, i.e. shortened in the axial direction so that its wall thickness is thereby increased.

Because of this greater wall thickness in the embodiment of FIG. 4, cutting of the internal screwthread into it is possible.

In this embodiment, in addition, lateral slit-like openings or holes 14 are punched into the tube stub 8 in the route region thereof, close to the inner surface of the cover 3 so that a more complete emptying of the barrel is possible when the barrel is removed.

For complete emptying of the barrel, the latter is turned upside down so that the barrel rests on the chime 4. In this case the contents of the barrel will drain through the bunghole 5 and then through the openings 14 to avoid an accumulation of the contents up to the level of the upwardly projecting tube stub 8 when the barrel is in this position.

Figure 5:
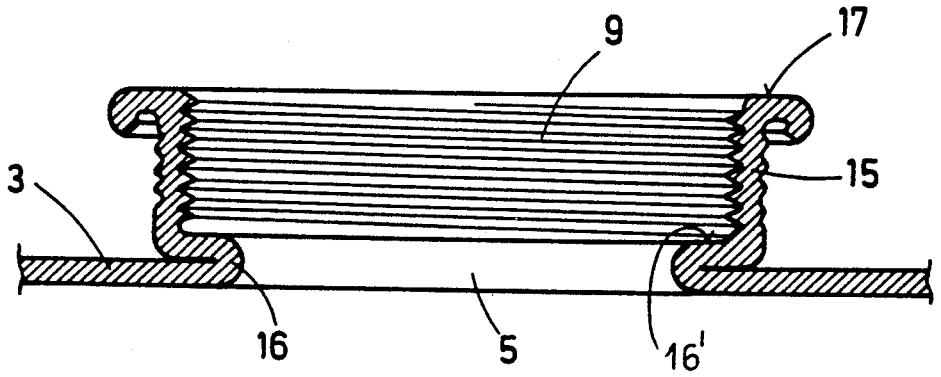
FIG. 5 is a cross sectional view of a bunghole and tube stub wherein that tube stub extends upwardly from the cover.

The invention is not limited to a tube stub extending into the container. In FIG. 5, for example, I show an outwardly extending tube stub 15 defining the bunghole 5 and deformed from the material which normally would have constituted the covering of this hole.

The tube stub 15 is provided with the internal screwthread 9 by cutting, rolling, twisting or like means.

The upper free end of the tube stub 15 has an outwardly turned flange forming a planar sealing surface 17 against which the ring 11 can seat.

The junction between the tube stub and the remainder of the cover 3 around the bunghole 5 is formed with a fold or corrugation 16 whose upper surface 16′ can form a sealing surface for another sealing ring if desired. The corrugation 16 prevents rupture at the junction of the tube stub with the remainder of the cover. In, for example, the embodiment of FIG. 3 it has been found to be advantageous that the sealing ring 11 presses against the sealing surface 10 of the cover 3 directly, i.e. there is a direct seal between the surface of the cover and the flange 13 of the bung 12 any problems arising with failure of the tube stub or a defect therein, or problems within the sealed container, this seal is not affected.

When the sealing surface 17 of FIG. 5 is used, the formation of the seal is not a problem but the formation of routine cracks in the screwthread can affect this seal. In this case, another sealing ring can engage the corrugation 16 as has been described so that once again a seal is formed at the route of the tube stub so that hairline crack problems of the type described do not affect the seal which is upstream thereof.

FIGS. 6 through 9 all illustrate another aspect of the invention in which the free end of the upwardly extending tube stub can be bent through 180° downwardly to form an inner wall within the outer wall of the upwardly extending portion of the tube stub.

In this case, the outer wall 18 has a transition 19 with an inner wall 20 in which the screwthread 9 is formed.

Figure 6:
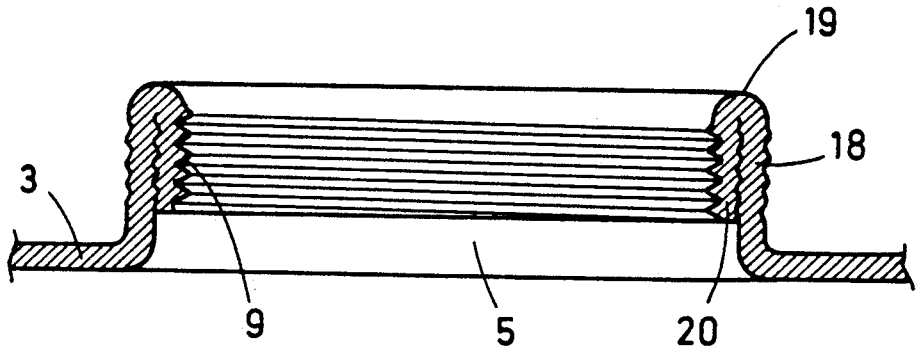
FIG. 6 is a similar view of an upwardly extending tube stub whose free end has been bent inwardly through 180° and in which the inner and outer walls thus formed are both deformed in the provision of the internal screwthread.

In the embodiment of FIG. 6 the transition region 19 is formed with a minimum radius of curvature so that the inner wall 20 lies practically against the outer wall and indeed deformation to form the screwthread can be effected through both inner and outer walls by a die pressing the two walls between them so that the outer surface develops a contour at least partly similar to that of the internal screwthread.

The transition region 19 here can form the annular sealing surface for engagement by the sealing ring 11 when the bung is applied.

Depending upon the shape of the flange of the bung, the sealing can be effected over the entire width of the transition region or only over upwardly and inwardly or upwardly and outwardly converging or diverging regions of the approximately frustoconical regions defined by the transition region. Since the tube stub has approximately twice the material thickness of the previously described embodiments, it has substantially greater stability and ensures that the screwthread will be provided in a sealed compartment of the container.

Figure 7:
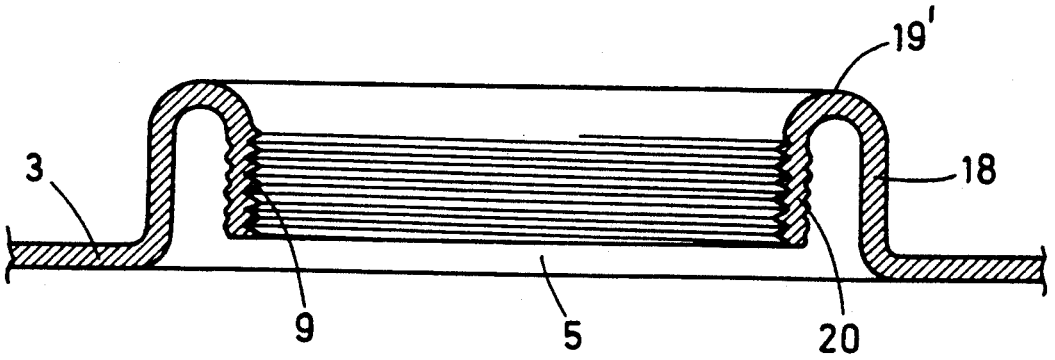
FIG. 7 is a view of an embodiment similar to FIG. 6 with a greater radius of curvature of the junction between the inner and outer walls.
Figure 5A:
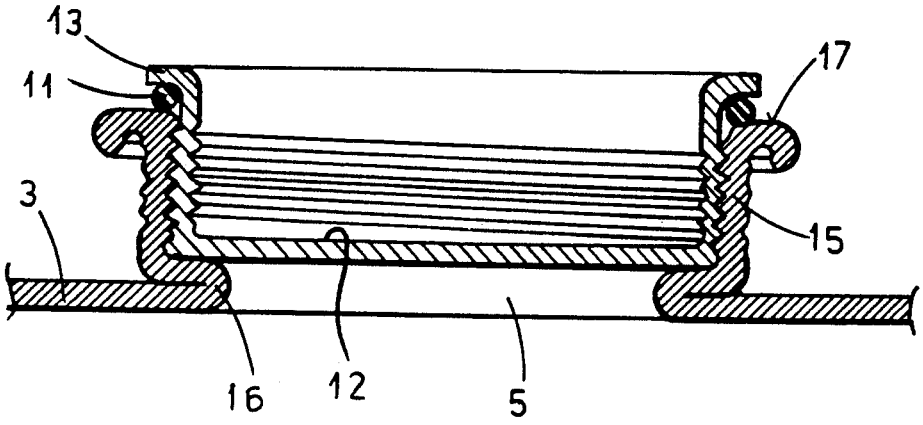
FIG. 5*a* is a cross sectional view of an externally threaded bung for use with a bung such as that shown in FIG. 5.
Figure 6A:
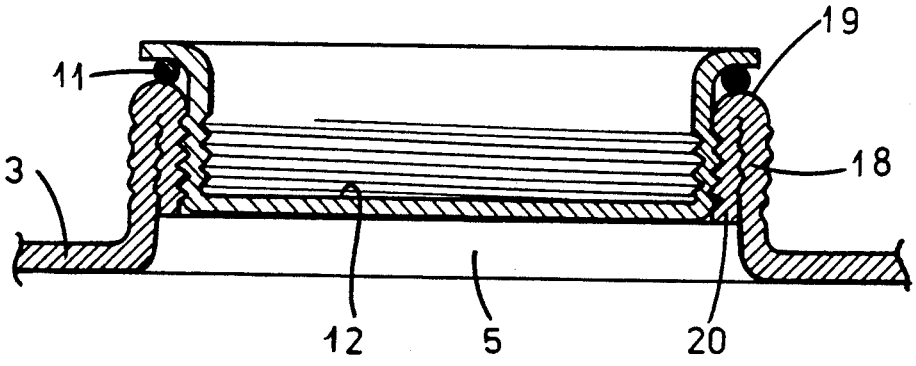
FIG. 6*a* is a cross sectional view of an externally threaded bung for use with a bung such as is shown in FIG. 6.

A variant on the configuration of the tube stub has been shown in FIG. 7 wherein the transition portion 19′ has a larger radius of curvature and is generally of semicircular cross section. In this arrangement, excessive deformation of the sheet metal in the transition region is avoided and, on the other hand, the inner wall 20 extends freely within the protective and supporting outer wall.

Figure 8:
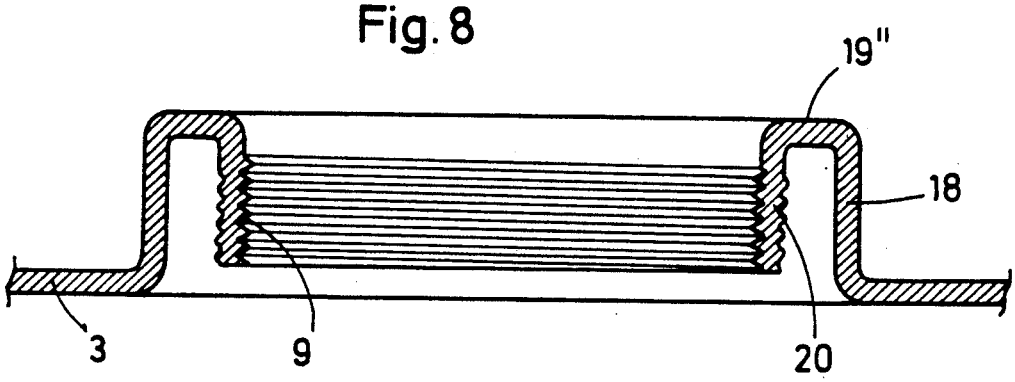
FIG. 8 is a view similar to FIG. 7 of an embodiment with a flange-type transition region forming the sealing surface.

In the embodiment of FIG. 8, the transition region 19" is squared off for the same spacing of the inner wall 20 from the outer wall 18. The upper surface of the transition region 19" is planar, annular and has, in cross section, two corner curves of quarter-circle cross section and minimum radius. A flat sealing surface is thus provided for the sealing ring.

Figure 9:
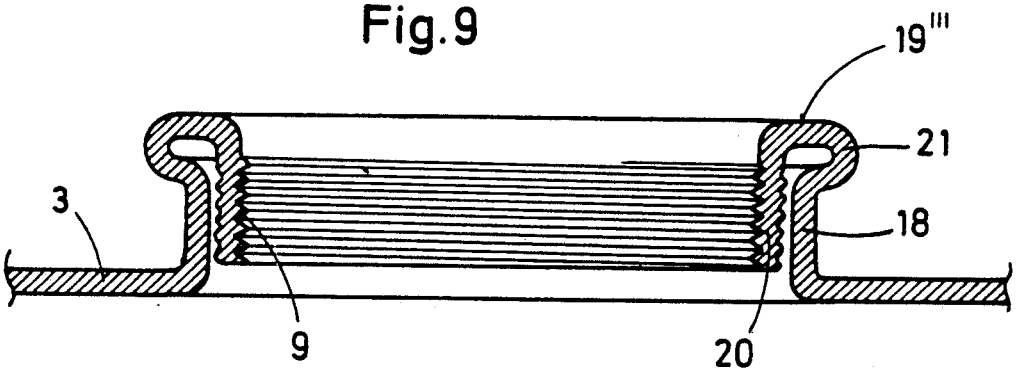
FIG. 9 is a similar cross sectional view of a further variant with the inner wall disposed close to the outer wall.

A similarly flat surface is provided in the embodiment of FIG. 9 wherein the transition region 19 has a bulge or corrugation 21 which acts as a stiffening member and yet allows the inner wall 20 to be disposed at only a minimum distance from the outer wall. The transition region forms the sealing surface as has been described.

Figure 10:
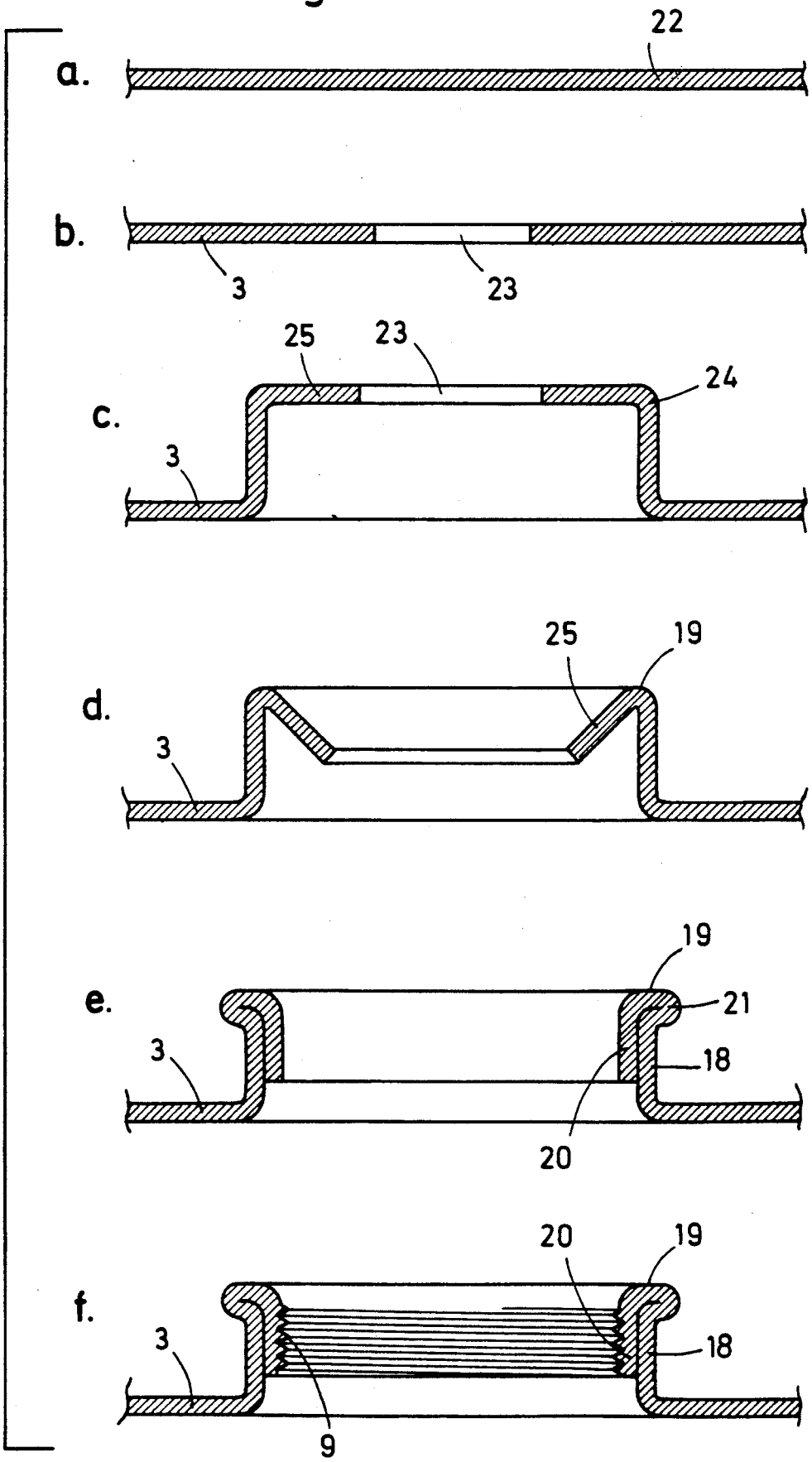
FIG. 10 is a diagram illustrating six phases in the formation of a tube stub of the type generally illustrated in FIG. 9.
Figure 13:
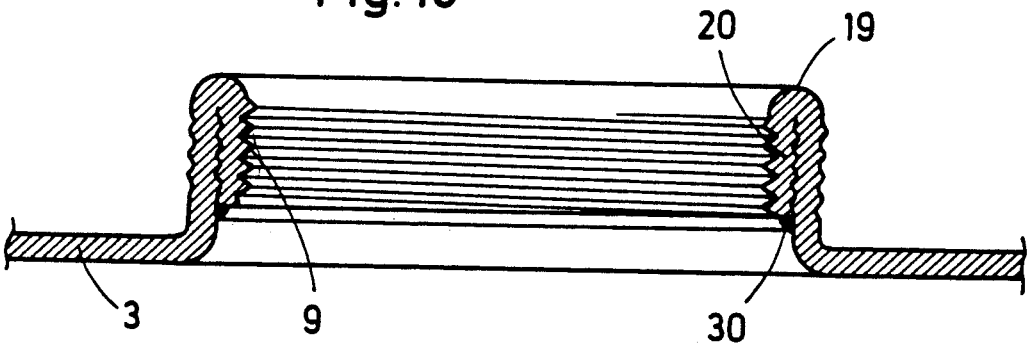
FIG. 13 is a cross sectional view of an embodiment similar to that of FIG. 6 but when the inner wall is secured to the outer wall additionally by welding.

Turning now to FIG. 10 in which the steps in formation of the tubular stub of FIG. 9 have been illustrated, it will be apparent that the starting material is a simple sheet metal workpiece 22(*a*) of a type which can be affixed to the container body to form the cover.

In an initial step (b) a hole 23 is formed in this workpiece of a diameter substantially smaller than the bunghole which is ultimately to be formed.

In step (c), the workpiece is deformed centrally with respect to the hole 23 into a cap profile 24.

A portion provided with the hole is then deformed downwardly (step d) to form the ring 25 which has a frustoconical configuration. As a result of this deformation, the hole increases in diameter.

The annular portion (step e) is then deformed to lie along the outer wall 18 as the inner wall 20 and the upper rim of the cap profile is bent outwardly to form the transition region and bulge as in FIG. 9. The bulge is here also indicated at 21.

A screwthread 9 is then formed in the inner wall (step f).

Figure 11:
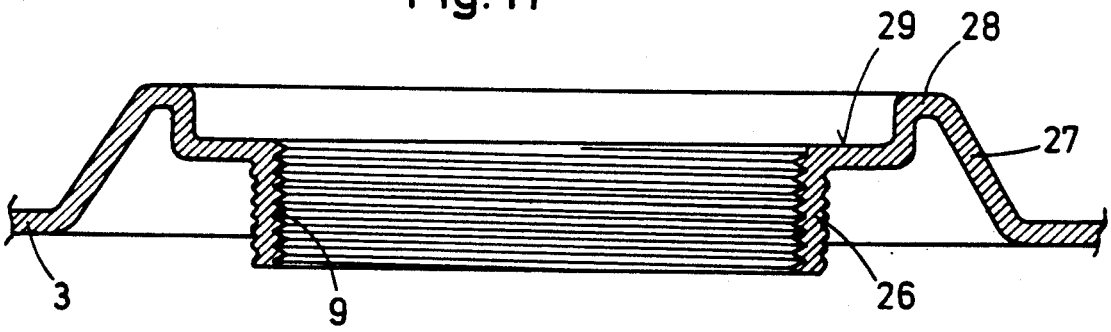
FIG. 11 is a cross sectional view of an embodiment in which a step or folded arrangement is provided to increase the resiliency between the tube stub and the cover and to show a sealing surface which is recessed according to the invention.

It has been found to be advantageous, in some cases, to stiffen the region around the tube stub by providing it with corrugations, steps or the like. For example, in FIG. 11 the tube stub 26 is connected to the remainder of the cover 3 around the bunghole 11 by a corrugation which has a rising frustoconical circular flank 27 bulging outwardly from the cover 3, an annular corrugation 28, an annular sealing surface 29 within the corrugation 28 and the tube stub 26 extending downwardly from the sealing surface 29.

In this embodiment, the bung 12 compresses with its flange 13, a sealing ring 11 against the upper surface of the corrugation 28 or against the surface 29.

Figure 12:
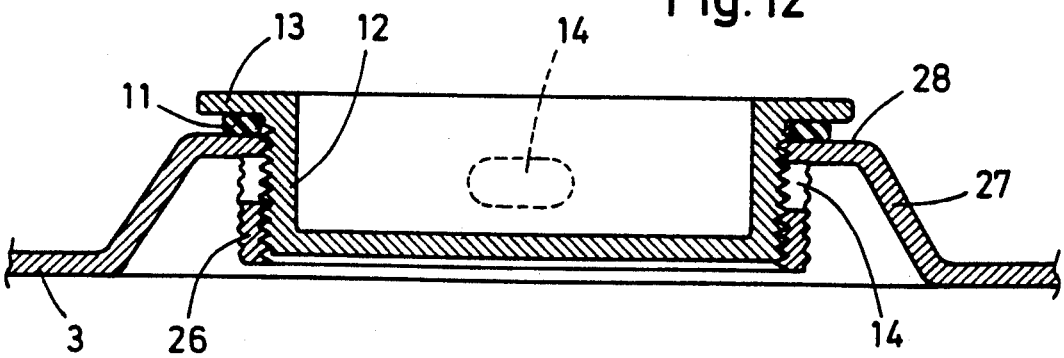
FIG. 12 is a cross sectional view in which a stiffening corrugation surrounds the threaded portion of a tube stub, illustrating the externally threaded bung in place.

The tube stub 26 can be provided with slit like opening 14 (compare FIG. 12) directly below the inner surface of the corrugation to ensure residue emptying when the container is inverted through 180° and stands on its chime. Under these circumstances the free end of the tube stub 26 will project above the inner surface of the cover 3 but run off from the inner surface will not be prevented.

The openings 14 permit drainage of any container contents which may accumulate above the corrugation 28.

It is significant to note here that any haircracks formed in manufacture in the inner thread or arising in use remain within the sealed region of the container contents and do not affect the sealing.

A further stiffening of this type is obtained by the systems illustrated in FIGS. 13–16. For example, in the embodiment of FIG. 13, the inner wall 20 which lies close to the outer wall 18, can be provided with a continuous weld seam or bead 30 bridging these walls.

Figure 14:
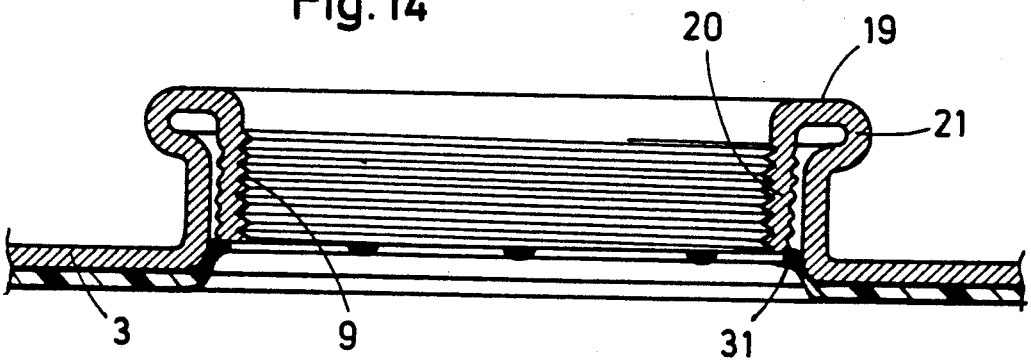
FIG. 14 is a cross sectional view of an embodiment similar to that of FIG. 9 with welding reinforcement.
Figure 15:
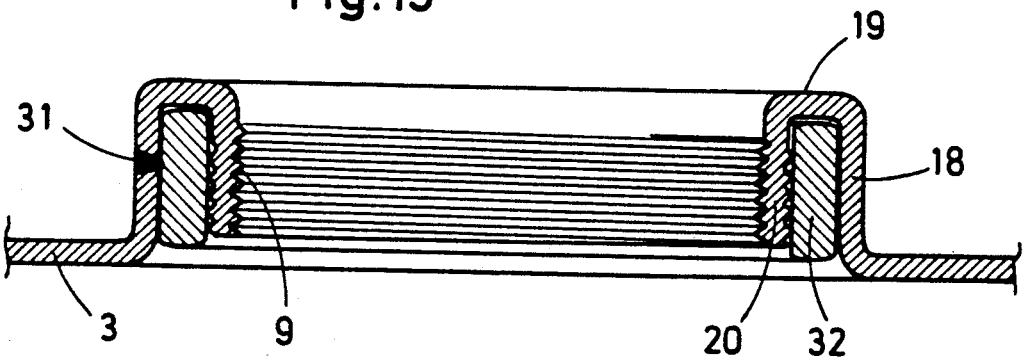
FIG. 15 is a cross sectional view of a bunghole and the associated tube stub similar to the embodiment of FIG. 8 but further comprising a reinforcing ring between the inner and outer walls.

Alternatively and as shown in FIG. 14, welds 31 may be provided at spaced apart locations around the free end of the inner wall 20. A lacquer coating may be provided on the tube stub (see FIG. 14) and the inner wall of the container.

Where the inner wall lies directly against the outer wall, the lacquer or plastic coating need not be applied on surfaces of these walls confronting one another. When a continuous weld seam is provided it may be sufficient to coat or lacquer the weld seam only and the surrounding portions of the cover.

Figure 16:
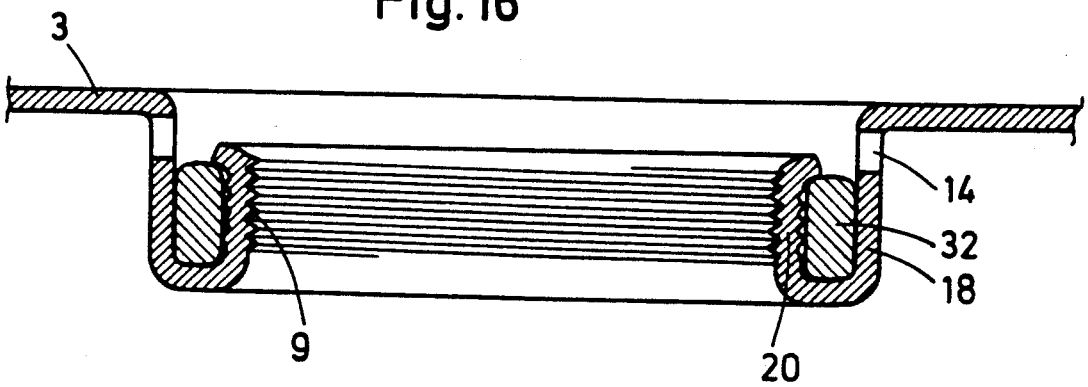
FIG. 16 is a cross sectional view of an inwardly extending tube stub having a reinforcing ring.

When a substantial distance is provided between the inner and outer wall (FIG. 15) an additional reinforcing ring 32 can be inserted between the walls and can be held in place by spot welds 31. The inner wall can be crimped over a reinforcing ring 32 as shown in FIG. 16, although spot welds or the like may be used here also to hold the reinforcing ring in place. The embodiment of FIG. 16 also has the throughgoing lateral openings 14 for total emptying of the container.

Figure 17:
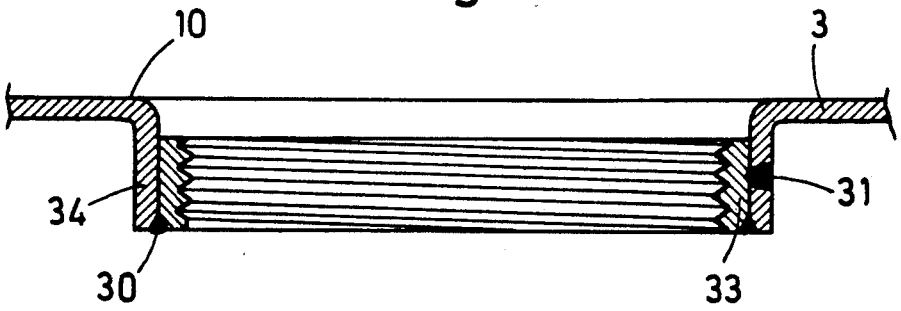
FIG. 17 is a cross sectional view through a bunghole tube stub in which a threaded bushing is provided.
Figure 18:
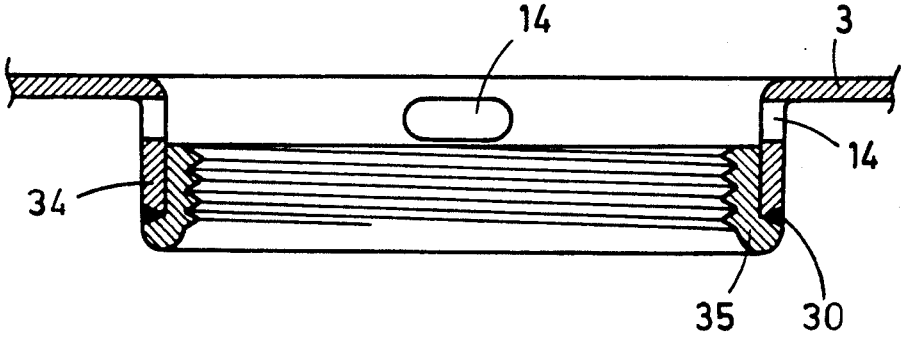
FIG. 18 is a cross sectional view of an embodiment using a threaded bushing engaging over the free end of the tube stub.

In line with the stiffening techniques described, it is possible according to the invention to provide a special threaded ring 33 which can be held in the tube stub 34 by spot welds 30 or by a continuous annular weld seam 30 or both. The latter weld seam can be provided in the region of the free lower end of the tube stub 34. The weld points 31 can be simplified by providing holes in the tube stub 34 which are filled with weldment. In this embodiment it is immaterial that there may be cracks in the weld 30 or between the ring 33 and the tube stub 34 since the sealing ring 11 engaging the sealing surface 10 prevents leakage through such cracks. The embodiment of FIG. 18 differs from that of FIG. 17 in that the threaded ring 35 also engages over the free end of the tube stub 34 and is welded thereto by the weld seam 30.

Figure 19:
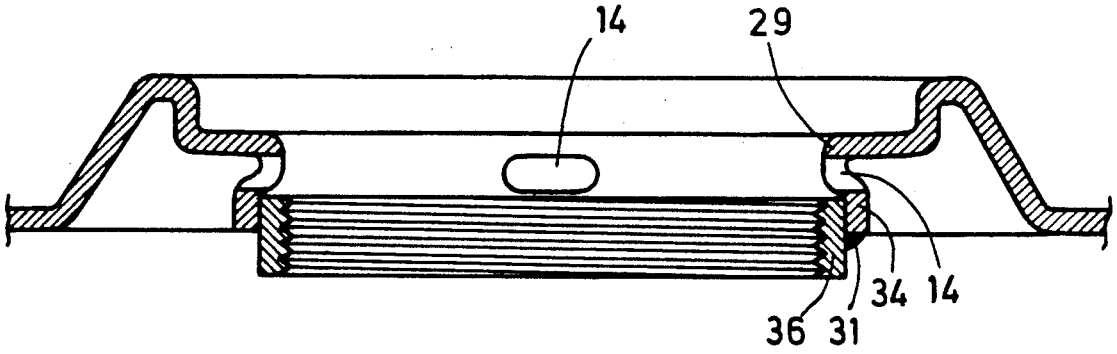
FIG. 19 is a cross sectional view of an embodiment in which stiffening corrugations above the upper cover surface are provided for a tube stub to which is secured a threaded ring extending the tube stub below the lower surface of the cover.

Another embodiment of a threaded ring is used in the system of FIG. 19. The threaded ring 36 here abuts a corrugation of the tube stub 34 connecting it to the surface 29 and which is provided with the drain openings 14. Otherwise the construction resembles that of FIG. 11.

Figure 20:
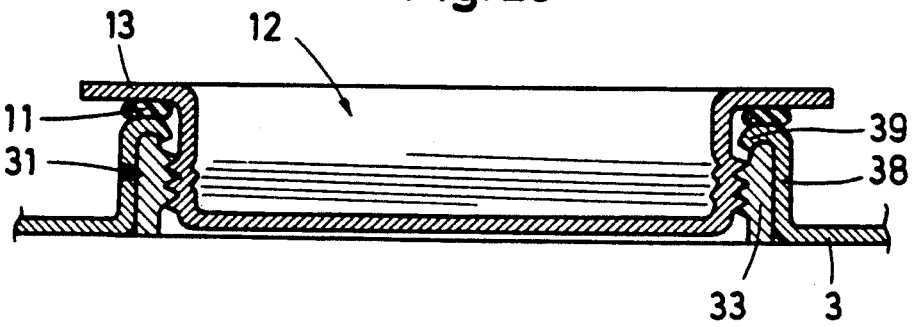
FIG. 20 is a cross sectional view of another embodiment of the invention having an upwardly extending tube stub held in place by a collar forming a sealing surface.

In the embodiment of FIG. 20, a tube stub 38 is formed in one piece with the cover and is lined with a threaded ring 33.

The upper end of the threaded ring is engaged by an inwardly bent transition region 39 which is clenched over this ring and supports the threaded ring 33 against axial forces arising when the bung 12 is screwed into this ring. The sealing ring 11 of the bung is clamped against the sealing surface 39. The threaded ring can also be held in place by spot welds 31.

Figure 21:
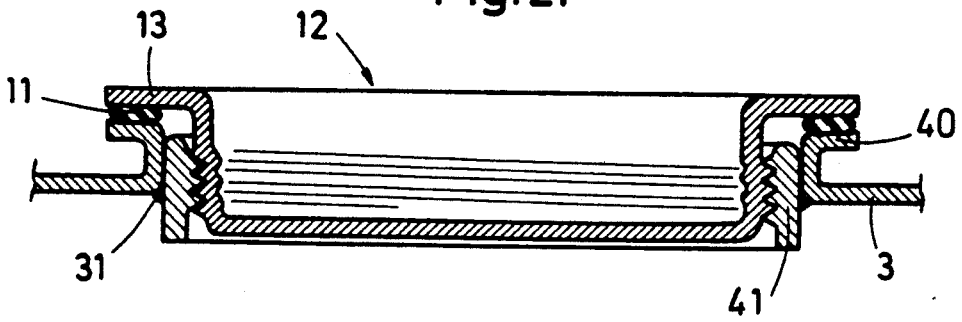
FIG. 21 is a cross sectional view of another embodiment utilizing the principles of FIG. 20.

A variation on this theme is found in FIG. 21. In this case, a corrugation 40 is formed from the material of the cover 3 and the upper surface of this corrugation forms the sealing surface. Within the corrugation a threaded ring, force fitted into the corrugation, is held by spot welds. Here again the sealing action is affected outwardly of the spot welded region so that a sealing weld need not be provided. In a further variation, a threaded ring is provided below the corrugation 40 against the cover and is partly welded thereto.

Figure 22:
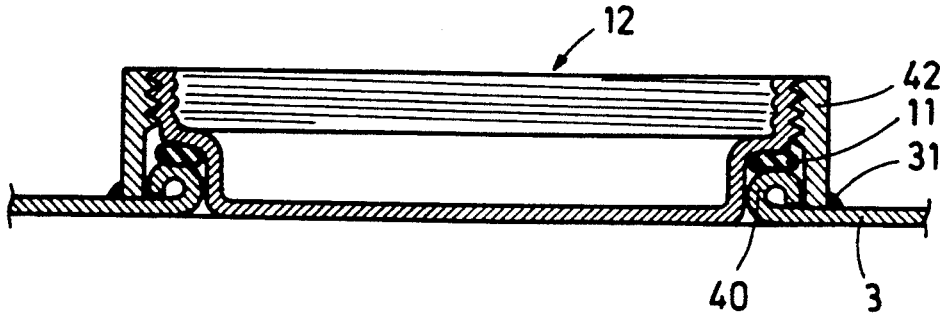
FIG. 22 is a cross sectional view of an embodiment in which the sealing surface is provided below the screwthread.

A connection above the sealing corrugation 40 has been illustrated in FIG. 22. Here the threaded ring 42 is so formed that its foot circle is centered by the periphery of the corrugation 40 and is welded with the remainder of the cover by spot welds 31 or a continuous weld seam.

In this case as well it is not necessary to seal the weld joint where the sealing ring 11 is located inwardly of this joint and the screwthread is outwardly thereof.

Figure 23:
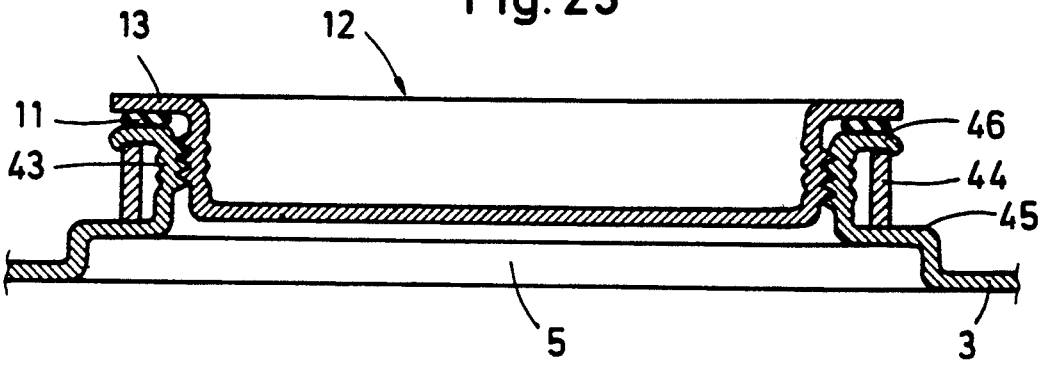
FIG. 23 is a cross sectional view of an embodiment providing additional stiffening via a bracing ring.

FIG. 23 shows a simplified stiffening of a tube stub 43 provided with the inner thread on an annular corrugation 45. On this corrugation a reinforcing ring 44 is mounted by welds and the upper end of the tube stub is formed with a flange 46 which is engaged over the ring 44.

The flange 46 forms the sealing surface for the sealing ring 11 of the bung additional welds can be made between the ring 44 and the corrugation 45 and between this ring and the flange 46.

To suppress corrosion, the reinforcing rings 32 or 44 and the threaded rings 33, 35, 36, 41 or 42 can be composed of a corrosion material, for example, stainless steel. If the cover is of the prelacquered type, after the formation of the tube stubs 8, 20 or 38 and after application of a reinforcing or threaded ring it is not required to lacquer this region again. All of the techniques described for forming a screwthread can be used in each embodiment and it has been found to be advantageous to engage the outer surface of the tube stub with a holder as a threaded mandrel is forced into the tube stub.

The radially displaceable support surfaces which also can have thread formations can be pressed against the outer walls of the tube stub so that a screwthread is pressed into the latter. The press plates are then withdrawn and the threaded mandrel has thus been unscrewed from the internal thread thus formed.

Figure 24:
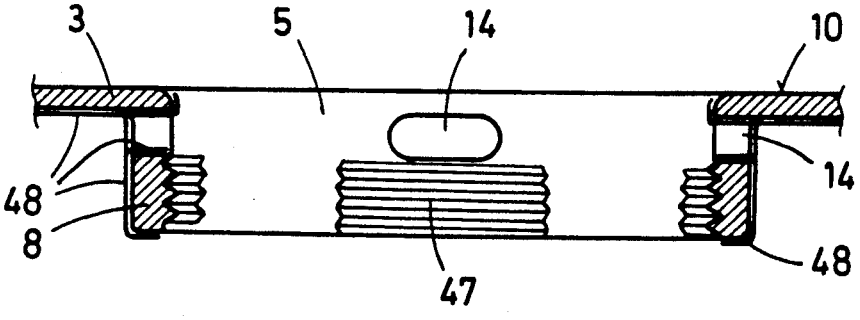
FIG. 24 is a cross sectional view illustrating the embodiment of the invention using sectorially spaced threaded portions.

The inner thread need not be continuous since, as shown in FIG. 24, it need be provided only in segments 47. A segmented threaded mandrel or thread cutter can be used to fabricate the internal screwthread in a particularly convenient manner.

A lacquer coating can be provided as shown at 48 in FIG. 24.

The invention can, of course, be applied to other containers such as open-top or closed-top tanks by simply providing the tube stub in a sidewall or bottom wall thereof using the principles already described.

I claim:

1. A bung-type container, comprising:

a container body;

a container bottom closing one end of said container body;

a cover closing an opposite end of said container body, said cover being formed with at least one bunghole defining an opening and, bounding said opening and formed in one piece with said cover, a tube stub having an internal screwthread and defining an annular sealing surface surrounding said opening and located on a side of said cover turned away from said container body; and an externally threaded bung threadedly received removably in said tube stub, forming a stopper for said opening and having a sealing ring pressed against said sealing surface, said tube stub extending outwardly away from the interior of said container and being shaped to define said at least one bunghole, said tube stub having a free upper end formed with an outwardly turned collar, said tube stub being formed with an inwardly directed folded double walled corrugation formed on a lower end of said tube stub and joining said tube stub to said cover.

2. A bung-type container, comprising:

a container body;

a container bottom closing one end of said container body;

a cover closing an opposite end of said container body, said cover being formed with at least one bunghole defining an opening and, bounding said opening and formed in one piece with said cover, a tube stub having an internal screwthread and defining an annular sealing surface surrounding said opening and located on a side of said cover turned away from said container body; and an externally threaded bung threadedly received removably in said tube stub, forming a stopper for said opening and having a sealing ring pressed against sealing said surface, said tube stub is double-walled and has an outer wall extending transversely from said cover and an inner wall formed with said internal screw thread, defining a free end of said tube stub and bent through 180° to lie coaxial with and inwardly of said outer wall and thereagainst over the entire length of said inner wall.

3. The bung-type container defined in claim 1 or claim 7, further comprising a protective coating on said tube stub and at least a portion of an inner surface of said cover adjoining said tube stub.

4. The bung-type container defined in claim 2 wherein an annular transition region is formed between said inner and outer wall at an outer end of said tube stub and forms said sealing surface.

5. The bung-type container defined in claim 4 wherein said sealing surface is frustoconical.

6. The bung-type container defined in claim 4, further comprising at least one weld joining said inner and outer walls.

7. The bung-type container defined in claim 6 wherein the free end of said inner wall is joined to said outer wall by a continuous annular weld seam.

* * * * *